US005774101A

United States Patent [19]

Hirai et al.

[11] Patent Number: 5,774,101

[45] Date of Patent: Jun. 30, 1998

[54] MULTIPLE LINE SIMULTANEOUS SELECTION METHOD FOR A SIMPLE MATRIX LCD WHICH USES TEMPORAL AND SPATIAL MODULATION TO PRODUCE GRAY SCALE WITH REDUCED CROSSTALK AND FLICKER

[75] Inventors: Yoshinori Hirai; Makoto Nagai; Akira Nakazawa; Kazuyoshi Kawaguchi; Takeshi Kuwata, all of Yokohama, Japan

[73] Assignee: Asahi Glass Company Ltd., Tokyo, Japan

[21] Appl. No.: 572,046

[22] Filed: Dec. 14, 1995

[30] Foreign Application Priority Data

Dec. 16, 1994 [JP] Japan ..... 6-313791

[51] Int. Cl.[6] ..... G09G 3/36; G09G 5/10

[52] U.S. Cl. ..... 345/89; 345/100; 345/148; 345/149

[58] Field of Search ..... 345/58, 89, 94, 345/100, 103, 208, 147, 148, 149

[56] References Cited

U.S. PATENT DOCUMENTS

| | | | |
|---|---|---|---|
| 5,068,649 | 11/1991 | Garrett | 345/147 |
| 5,254,982 | 10/1993 | Feigenblatt et al. | 345/148 |
| 5,266,940 | 11/1993 | Shiraishi | 345/148 |
| 5,298,915 | 3/1994 | Bassetti, Jr. | 345/149 |
| 5,420,604 | 5/1995 | Scheffer et al. | 345/100 |
| 5,459,495 | 10/1995 | Scheffer et al. | 345/147 |
| 5,473,338 | 12/1995 | Prince et al. | 345/58 |
| 5,475,397 | 12/1995 | Saidi | 345/100 |
| 5,479,188 | 12/1995 | Moriyama | 345/149 |
| 5,481,651 | 1/1996 | Herold | 345/100 |
| 5,485,173 | 1/1996 | Scheffer et al. | 345/100 |
| 5,548,302 | 8/1996 | Kuwata et al. | 345/100 |
| 5,552,800 | 9/1996 | Uchikoga et al. | 345/149 |
| 5,583,530 | 12/1996 | Mano et al. | 345/89 |
| 5,594,466 | 1/1997 | Yamamoto et al. | 345/100 |
| 5,596,344 | 1/1997 | Kuwata et al. | 345/103 |

*Primary Examiner*—Steven Saras
*Assistant Examiner*—Paul A. Bell
*Attorney, Agent, or Firm*—Oblon, Spivak, McClelland, Maier & Neustadt, P.C.

[57] ABSTRACT

A method of driving an image display device including the steps of: dividing row electrodes of an image display device having a plurality of row electrodes and a plurality of column electrodes into a plurality of subgroups; selecting summarizingly one of the plurality of subgroups; applying voltages based on signals formed by expanding time-sequentially column vectors of an orthogonal matrix on the row electrodes; performing a gray scale display by a frame rate control (FRC) by using a plurality of frames; performing a space modulation shifting a phase of the FRC with a pixel block comprising a plurality of pixels as a unit; and wherein the phase of the space modulation is set such that a ratio of the columns each applying an equally effective voltage on all of the pixels in the column in each frame in displaying an intermediate gray scale level by all of the pixels belonging to the same subgroup is 40% or more on an average of all of the intermediate gray scale levels and all of the frames.

14 Claims, 4 Drawing Sheets

FIGURE 3 (a) *PRIOR ART*
EXAMPLE OF 4x4 HADAMARD'S MATROX
(A)
L = 1 1 1 1 1
L = 2 1 -1 1 -1
L = 3 1 1 -1 -1
L = 4 1 -1 -1 1
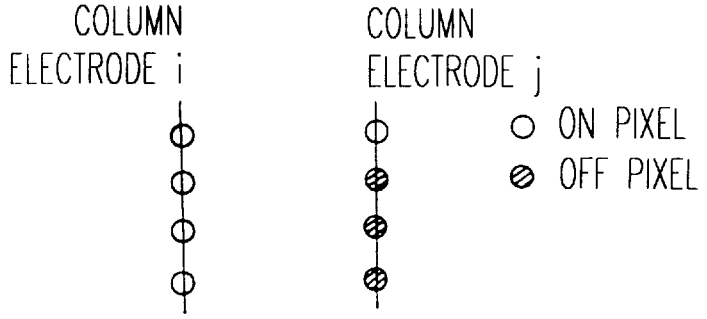
FIGURE 3 (b) *PRIOR ART*
COLUMN ELECTRODE i
(d) ( -1 -1 -1 -1 )
(v) (-4 0 0 0 )
COLUMN ELECTRODE j
(d) ( -1 1 1 1 )
(V) ( 2 -2 -2 -2 )
FIGURE 3 (c) *PRIOR ART*
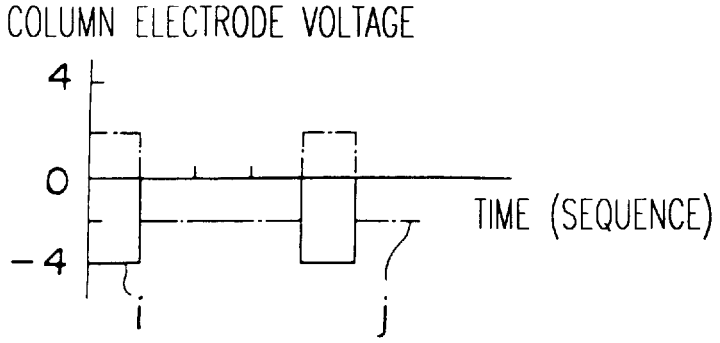

FIGURE 4 (a) *PRIOR ART*

$$(A) = \begin{pmatrix} 1 & 1 & 1 & 1 \\ 1 & -1 & 1 & -1 \\ 1 & 1 & -1 & -1 \\ 1 & -1 & -1 & 1 \end{pmatrix}$$

FIGURE 4 (b) *PRIOR ART*

$$(A) = \begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

FIGURE 4 (c) *PRIOR ART*

$$(A) = \begin{pmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

MULTIPLE LINE SIMULTANEOUS SELECTION METHOD FOR A SIMPLE MATRIX LCD WHICH USES TEMPORAL AND SPATIAL MODULATION TO PRODUCE GRAY SCALE WITH REDUCED CROSSTALK AND FLICKER

BACKGROUND OF THE INVENTION

1. Field of the Invention

The present invention relates to a method of driving a liquid crystal display deice which is suitable for liquid crystals responding at a high speed, particularly to a method of driving a simple matrix type liquid crystal display device performing a multiplex driving by the multiple line simultaneous selection method.

2. Discussion of Background

Hereinafter, in this specification, a scanning electrode is designated as a row electrode and a data electrode is designated as a column electrode.

With the progress of advanced information age need for information media has been more enhanced. A liquid crystal display has advantages such as thin structure, light weight, low power consumption etc. and it seems that its coordination with semiconductor technology will more prevail. Meanwhile, with spread of liquid crystal displays expansion and high definition of a screen are required and a search for a method of performing a large capacity display is beginning. Among them the STN (super-twisted nematic) system seems to be the main stream of future liquid crystal display since its manufacturing steps are simplified and displays can be manufactured at low cost compared with those of the TFT (thin-film transistor) system.

The line by line selection method has conventionally been carried out in the STN system to achieve the large capacitance display. In this method, respective row electrodes are successively selected one by one and column electrodes are driven in correspondence with a pattern to be displayed, and the display of one screen is finished after all the row electrodes have been selected.

However, it has been known in the line by line selection method that there causes a problem called frame response with an increase in the display capacity. In the line by line selection method a comparatively large voltage is applied on a pixel in selection time and a comparatively small voltage is applied thereon in nonselection time. The ratio of the voltages is generally increased with an increase in the number of row lines (with an increase in high duty drive). Accordingly, a liquid crystal which responds to an effective value of voltage (RMS voltage) when the voltage ratio is small, now responds to an applied waveform. That is, the frame response is a phenomenon in which the transmittance of a liquid crystal at OFF time is increased since the amplitude at a selection pulse is large, the transmittance thereof at ON time is decreased since the period of the selection pulses is long and as a result, lowering of the contrast ratio is caused.

Although there has been known a method of increasing the frame frequency by which the period of the selection pulse is shortened, to restrain the occurrence of the frame response, it has a serious drawback. That is, the frequency spectrum of applied waveform becomes higher with the increase in the frame frequency and accordingly, nonuniformity of display is caused and power consumption is increased. Therefore, the upper limit of the frame frequency is restrained to prevent too narrow selection pulse width.

A new driving method has recently been proposed to solve the problem without making the frequency spectrum higher. That is the multiple line simultaneous selection method simultaneously selecting a plurality of row electrodes (selection electrodes). According to this method a plurality of row electrodes are simultaneously selected and a display pattern in column direction can independently be controlled by which the frame period can be shortened while maintaining the selection width constant. That is, a high contrast ratio display restraining the frame response can be achieved.

In the multiple line simultaneous selection method constant voltage pulse series are applied to the plurality of row electrodes selected simultaneously to independently control the column display pattern. In this driving method simultaneously selecting the plurality of lines, the voltage pulses are simultaneously applied on the plurality of row electrodes. Accordingly, it is necessary to apply pulse voltages having different polarities to the row electrodes to simultaneously and independently control the display pattern in the column direction. Pulses having polarities are applied by a plurality of times and voltages in correspondence with data are applied on the column electrodes. In this way, effective voltages in response to ON and OFF are applied on the respective pixels as a total.

The series of the selection pulse voltages applied on the respective electrodes can be designated by a matrix of L rows and K columns (hereinafter, selection matrix (A)). The selection pulse voltage series can be represented as mutually orthogonal vector groups and therefore, the matrix including these as column elements becomes an orthogonal matrix. Respective row vectors in the matrix are mutually orthogonal. The number of rows L corresponds to the number of simultaneously selected rows and each row corresponds to each line. For example, the element of the first line of the selection matrix (A) is applicable to line 1 among L selection lines. Further, the selection pulses are applied in the order of the element of the first column, the element of the second column and so on.

In this specification with regard to the description of the selection matrix (A), numeral 1 designates a positive selection pulse and numeral −1 designates a negative selection pulse. FIGS. 4(*a*), 4(*b*) and 4(*c*) show Hadamard's matrices as representative examples of the selection matrix (A). FIG. 4(*a*) shows that of 4 rows and 4 columns, FIG. 4(*b*) shows that of 8 rows and 8 columns and FIG. (c) shows that of 7 rows and 8 columns which is formed by removing the first row of that of 8 rows and 8 columns.

Voltage levels in correspondence with respective column elements of the matrices and a column display pattern are applied on the column electrodes. That is, the column electrodes voltage series are determined by the matrices determining the row electrode voltage series and the display pattern.

A sequence of voltage waveforms applied on the column electrodes are determined as follows. FIGS. 3(*a*), 3(*b*) and 3(*c*) are explanatory diagrams showing the concept. An explanation will be given thereof with Hadamard's matrix of 4 rows and 4 columns as an example. The display data at a column electrode i and a column electrode j are as shown by FIG. 3(*a*). Column display patterns are designated by vectors (d) as shown by FIG. 3(*b*). Here, −1 of a column element designates ON display and 1 thereof designates OFF display. When the row electrode voltages are applied on the row electrodes in the order of the columns of the matrix, the column electrode voltage levels become vectors (v) as shown by FIG. 3(*b*) and the waveforms are as shown by FIG. (c). Arbitrary units are used in the ordinate axis and the abscissa axis in FIG. 3(*c*).

In the case of partial line selection, it is preferable to apply voltages dispersingly in one display frame to restrain the frame response of the liquid crystal display. Specifically, for example, after applying the first element of the vector (v) corresponding to the first simultaneously selected row electrode group (hereinafter, the simultaneously selected row electrode group is designated as subgroup), the first element of the vector (v) is applied on the second simultaneously selected row electrode group and the same sequence is carried out successively.

Therefore, an actual voltage pulse sequence applied on the column electrodes is determined by how the voltage pulses are dispersed in one display frame and which selection matrix (A) is selected to the respective simultaneously selected row electrode group.

Meanwhile, it has been proposed to use the frame rate control (FRC) in gray scale display of the multiple line simultaneous selection method. FRC is a system in which ONs or OFFs are dispersed among a plurality of frames and the gray scale is expressed by the average brightness. Many frames are required for a multiple gray scale formation (for example, 8 gray scales or more) in FRC. Therefore, a time period until the display is completed is prolonged and flicker are generated. Accordingly, in the line by line selection method, in addition thereto, a method called space modulation which shifts a phase of dispersion of ONs and OFFs among contiguous pixels, is generally used.

FIGS. 5(*a*) and 5(*b*) shows a method of display by combining FRC with the space modulation. These figures show an example of performing the space modulation by using dots of 3 rows and 3 columns where 4 gray scales are displayed by using time-sequentially expanded 3 frames. In these figures a white circle designates ON and a black circle designates OFF. FIG. 5(*a*) shows three ON/OFF tables used for the respective three frames. The ON/OFF table has elements corresponding to pixels of a pixel block which is a unit of the space modulation. Further, the driving is performed such that assuming that full OFF designates a 0-th gray scale and full ON designates a 3rd. gray scale, the pixel is ON when gray scale data is larger than the value of the table and OFF otherwise. FIG. 5(*b*) designates a sequence of ON/OFF patterns when the 1st. gray scale is displayed.

In the conventional line by line selection method the selection is performed line by line and accordingly, it has almost no coordination with the combination of the space modulation and FRC and the respective conditions can independently be determined. However, in the multiple line simultaneous selection method a plurality of lines are simultaneously selected and accordingly, the space modulation and the selection pulse series are correlated with each other. Accordingly, when the multiple line simultaneous selection method is simply combined with the space modulation-FRC, considerable cross talk is generated in a specific display, or variation of display such as flicker is generated which deteriorates the quality of display.

SUMMARY OF THE INVENTION

The present invention provides the following method of driving an image display device to resolve the above-mentioned problem.

That is, the present invention provides a method of driving an image display device in which row electrodes of an image display device having a plurality of row electrodes and a plurality of column electrodes into subgroups each having a plurality of row electrodes, respective subgroups are summarizingly selected, voltages based on signals formed by time-sequentially expanding column vectors of an orthogonal matrix are applied on the row electrodes and a gray scale display is performed by a frame rate control (FRC) method using a plurality of frames, wherein a space modulation shifting a phase of the FRC is performed with a pixel block comprising a plurality of pixels as a unit and in each of the plurality of frames in displaying one intermediate gray scale level by all of the pixels belonging to the same subgroup, a phase of the space modulation is set such that a ratio of columns in each of which an equal effective voltage is applied on all of the pixels in the column is 40% or more, preferably 50% or more on an average of all of the intermediate gray scale levels and all of the frames.

Further, the present invention provides a method of driving an image display device according to the above-mentioned aspect wherein a line number J of the rows of the pixel block for performing the space modulation is equal to a number L of the simultaneously selected rows or one of them is a multiple of the other.

Moreover, the present invention provides a method of driving an image display device according to the above-mentioned aspect, wherein the phase of the space modulation is set such that in each of the plurality of frames in displaying one intermediate gray scale level by all of the pixels belonging to the same subgroup, a total ratio of first ON/OFF patterns in each of which an equal effective voltage is applied on all the pixels in one column and second ON/OFF patterns in each of which a column voltage having an absolute value equal to an absolute value of the column voltage in the first ON/OFF patterns is applied thereon, is 60% or more on an average of all of the intermediate gray scale level and all of the frames.

BRIEF DESCRIPTION OF THE DRAWINGS

FIGS. 3(*a*), 3(*b*) and 3(*c*) illustrate conceptual diagrams and a waveform diagram explaining a method of applying voltages in the multiple line simultaneous selection method;

FIGS. 4(*a*), 4(*b*) and 4(*c*) are explanatory diagrams showing Hadamard's matrices.

DETAILED DESCRIPTION OF THE PREFERRED EMBODIMENTS

Figure 1:
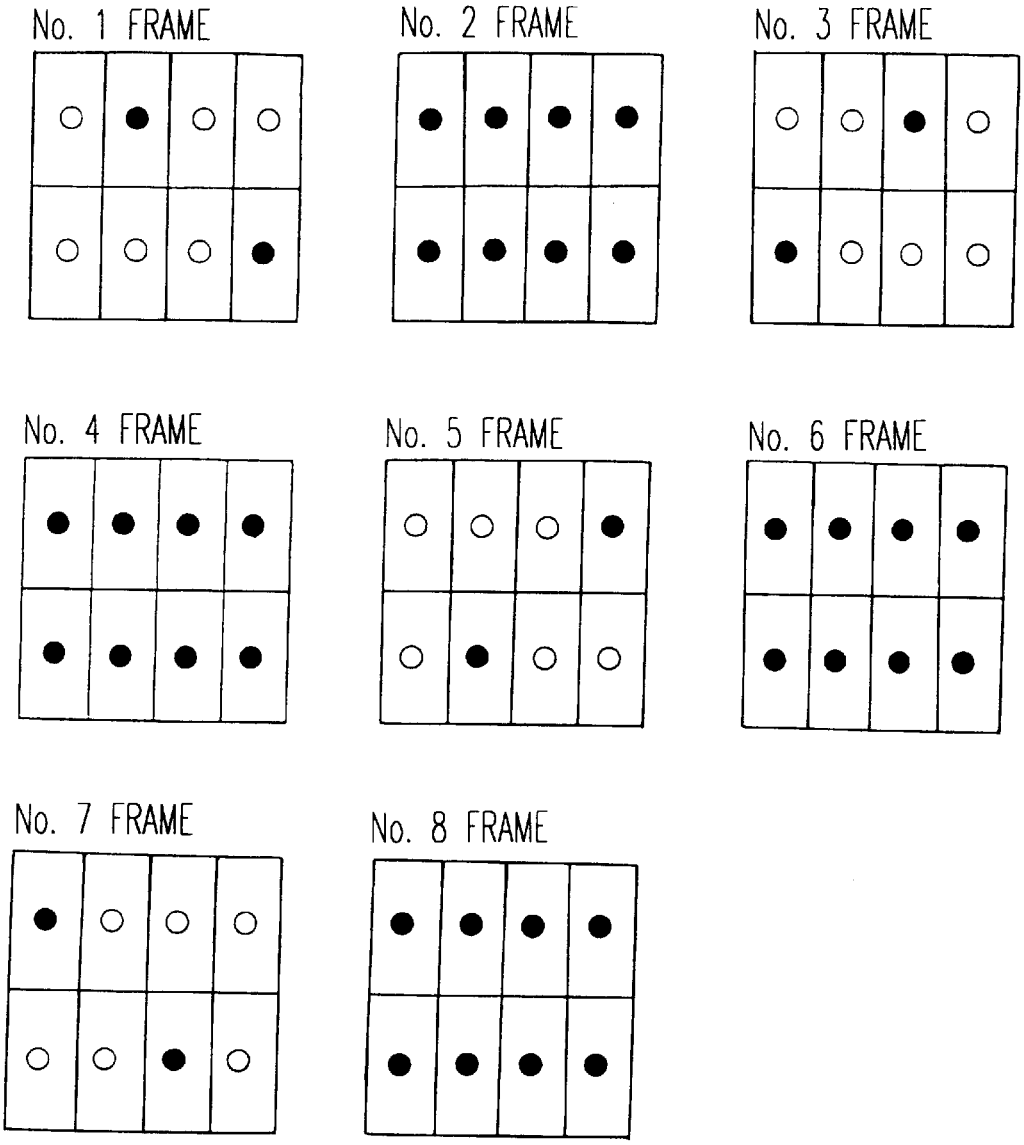
FIG. 1 illustrates diagrams each showing ON/OFF patterns in an embodiment of a method of driving an image display device of the present invention.

The inventors have studied the characteristics of the multiple line simultaneous selection method and the system of space modulation and discovered a system making the most of advantages of both the multiple line simultaneous selection method and the space modulation-FRC.

That is, according to the present invention, in gray scale display cross talk is suppressed and made uniform and inconspicuous by controlling specified dot patterns to occur with high probability. It is the characteristic of the multiple line simultaneous selection method that the size of cross talk is considerably changed by dot patterns in simultaneously selected lines. The present invention utilizes this characteristic. It is the normal practice in the conventional line by line selection method to make dot patterns of display as random as possible to thereby prevent flickers. Therefore, this point is very different from the conventional technology.

The "column in which an equally effective voltage is applied on all the pixels in the column" in the present invention corresponds to the "column in which all the pixels are ON or OFF" in a simple FRC with no amplitude modulation or pulse height modulation. In case of a FRC with the amplitude modulation or the like a frame in which an effective voltage corresponding to an intermediate gray scale is applied by a plurality of subframes may be constituted. Such a case is not always limited to a case of all ON pattern or all OFF pattern. An explanation will be given mainly of a case without the amplitude modulation or the like as follows.

Concept of a threshold table and a phase table is introduced for convenience of explaining the present invention.

A threshold table is a vector having elements of a number equal to a number of frames used in FRC. Each element designates a threshold for determining whether ON voltage is to be applied or OFF voltage is to be applied in each frame. That is, when inputted gray scale data is larger than an element of a threshold table corresponding to the frame, ON voltage is applied and when it is equal to or lower than the element of the threshold table, OFF voltage is applied.

Meanwhile, the phase table has elements each corresponding to an element in a pixel block to which the space modulation is applied. Each element shows from which element in the threshold table the element is successively applicable as a threshold with regard to the pixel. That is, this is a table determining a phase state of each pixel.

An explanation will be given of a case where input data of a gray scale number m (each gray scale is indicated by an integer of 0 to m−1) are displayed by allocating them into (g+1) gray scales by FRC having a frame number g and a pixel block of space modulation comprises k rows and h columns.

In this case the threshold table T(n) is a vector having g elements and each element can take an integer of 0 to m−1. Further, the phase table P(i,j) is a matrix of k rows and h columns and each element can take an integer of 0 to g−1. At a F-th frame of FRC the threshold of a pixel (i,j) is T(P(i,j)+F−1), ON display is performed when inputted gray scale data is larger than this value and OFF display is performed when inputted gray scale data is equal to or less than this value.

In the present invention the phase of the space modulation is set such that in each frame in displaying an intermediate gray scale level by all the pixels belonging to the same subgroup, a ratio of columns each being applied with an equal effective voltage (or columns which become ON or OFF) with regard to all the pixels in the column is equal to or more than 40%, preferably equal to or more than 50% on an average of all the intermediate gray scale levels and all the frames. Hereinafter, the ratio is designated as "solid probability" for simplicity. In this way cross talk can be made inconspicuous as a whole, since the probability of a display pattern of all ON or all OFF in a respective frame is high.

Conditions of the threshold table and the phase table effective for rendering the solid probability equal to or more than 40%, are, for example, as follows.

Firstly, elements in the threshold table carry a constant periodicity. When the value of an element in the threshold table is large, in a frame corresponding to the element, a probability of applying OFF voltage becomes high. Conversely, when the value of the element in the threshold table is small, in a frame corresponding to the element, the probability of applying ON voltage becomes high. Therefore, by providing a constant periodicity in elements of the threshold table, with regard to each pixel, large and small probabilities of applying ON voltage are periodically caused.

Under this state phase difference between elements in each column of the phase table is rendered a multiple of the above-mentioned period. Then, the probability of applying ON voltage is increased or decreased synchronizingly with regard to all the pixels of each column and accordingly, there causes columns which have high probability of becoming all ON pattern and columns which have high probability of becoming all OFF pattern, in one frame.

An explanation will be given of one of embodiments of the present invention by using a threshold table and a phase table. 4 row electrodes are simultaneously selected and the size of a pixel block for space modulation is 2×4. Further, simultaneously selected row electrodes comprise two pixel blocks in the column direction. That is, one pixel block does not extend to a plurality of subgroups. Data input is consisted of 4 bits (16 gray scales) and respective gray scale data are indicated by integers of 0 through 15. Further, 8 frames are used for FRC and display is performed by finally being allocated with 9 gray scales.

The following equation (1) indicates a threshold table T(n) and a phase table P(i,j).

$$T(n)=(1, 14, 5, 9, 3, 12, 7, 8) \quad (1)$$

$$P(i,j) = \begin{bmatrix} 0 & 6 & 4 & 2 \\ 4 & 2 & 0 & 6 \end{bmatrix}$$

In this case the periodicity of elements of the threshold table is 2 and states in which all ON (or all OFF) is easy to cause are generated at every 2 frames. Specifically, in the elements in the threshold table, ones having values of 8 or more, ones having values 7 or less are present at every 2 frames. Further, the phase differences in the respective columns in the phase table is 4 (a multiple of 2).

For example, consider a case of displaying a gray scale "6" by all the pixels in one pixel block. The light patterns in the pixel block in this case in respective frames are shown by FIG. 1.

In FIG. 1, 24 columns are all OFF or all ON in 32 columns. The pixel block does not extend to a different subgroup and the same threshold table and phase table are applied to all over the screen. Therefore, the columns having all OFF pattern or all ON pattern in the column direction indicate all OFF pattern or all ON pattern in view of the total of the screen. Accordingly, a solid display of 75% is constituted with regard to the total of the screen.

In the similar way the following Table 1 shows how much percent of columns become all ON pattern or all OFF pattern in each frame in displaying one intermediate gray scale level by all the pixels belonging to the same subgroup, with regard to all of respective 16 gray scale levels.

TABLE 1

| Gray scale level | 0 | 1 | 2 | 3 | 4 | 5 | 6 | 7 |
|---|---|---|---|---|---|---|---|---|
| Ratio % | 100 | 100 | 75 | 75 | 100 | 100 | 75 | 75 |
| Gray scale level | 8 | 9 | 10 | 11 | 12 | 13 | 14 | 15 |
| Ratio (%) | 100 | 75 | 75 | 100 | 100 | 75 | 75 | 100 |

By averaging with regard to the gray scale levels 1 through 14 in which the intermediate gray scale display is performed among them, 85.7% of columns become all ON or all OFF. That is, by using the threshold table and the phase table of Equation 1 the solid probability becomes 85.7% that is a very high value.

Accordingly, the probability of columns displaying all ON or all OFF in respective frames is much increased by adopting the threshold table and phase table of Equation 1 by which images having inconspicuous cross talk can be provided.

Actually, the solid probability can be rendered at least 50% or more by determining the number of columns of a pixel block to which space modulation is applied as 2 without especially devising the threshold table or the phase table. Therefore, it is a very preferable embodiment in the present invention to determine the number of columns in the pixel block as 2.

In this embodiment each table is set such that the key note of odd number frames is all ON pattern and that of even number frames is all OFF pattern. However, it is possible to determine the table such that all OFF pattern and all ON pattern alternately constitute the key note column by column in each frame.

Further, although in this embodiment the threshold table having the periodicity by a unit of 2 frames is adopted and accordingly, the ON/OFF pattern changes by a unit of 2 frames in accordance thereto, 3 frames or 4 frames may be the unit of periodicity. These may be determined in accordance with display quality, display resolution, display size or the like.

Figure 5:
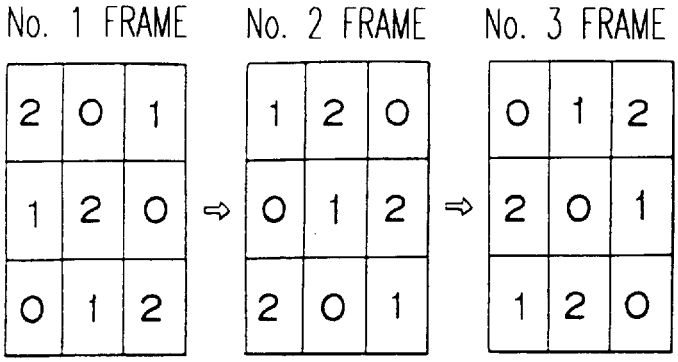
FIGS. 5(*a*) and 5(*b*) are explanatory diagrams explaining a FRC system with space modulation.
Figure 5:
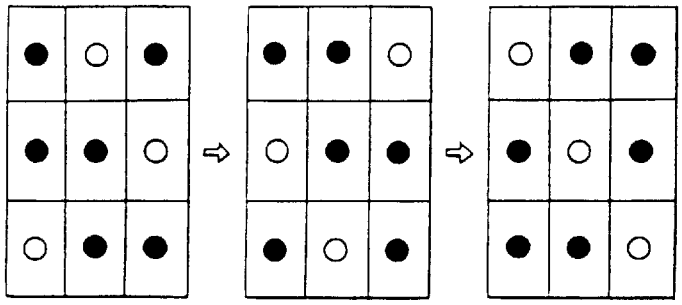

Although in the above explanation the threshold table and the phase table are used, these relationships can be shown by ON/OFF tables for respective frames as shown by FIGS. 5(*a*) and 5(*b*). However, the circuit design can more be simplified by using the threshold table and the phase table as circuit parts than by preparing the ON/OFF table for each frame.

Meanwhile, the coordination between the size of the pixel block that is the unit of space modulation and the number of simultaneously selected row electrodes is important in reducing cross talk. In one embodiment of the present invention a number of row of space modulation unit J is made equal to a number of simultaneously selected row electrode L or one is made a divisor of the other. In this way noncoordination of the multiple line simultaneous selection method and the space modulation-FRC is considerably reduced and gray scale display in which flickers are reduced by space modulation can be provided.

The noncoordination here is as follows. If L and J are in disagreement and are not in a relationship of multiples to each other, series of selection pulses differ by subgroups even in displaying a uniform intermediate gray scale. Therefore, it is difficult to perform a uniform drive all over the screen. That is, there is a case where although an applied waveform gradually changes in a specified subgroup, the waveform considerably changes in other subgroup. Thereby, nonuniformity of brightness is caused depending on locations.

In the multiple line simultaneous selection method a voltage in proportion of an inner product of a column electrode display pattern vector $(x)=(x_1, x_2, x_3, x_4 \ldots)$ having elements of a display pattern (OFF is designated by 1, ON is designated by −1) on a specified column electrode corresponding to simultaneously selected row electrodes by a column vector of a selection matrix ($A_i$: i=1, 2, 3, 4 . . . ) specified below is applied on column electrodes.

$$y_i=(x_1, x_2, x_3, x_4 \ldots)A_i$$

Therefore, the pattern of (x) is an important factor directly determining the voltage. When space modulation is used, typical patterns of (x) is a solid pattern, a pattern which periodically changes by every other column or the like. When the size of the space modulation is not in the above-mentioned specified relationship with the simultaneously selected line number L, various kinds of (x) are caused and as a result the voltages y applied on the column electrodes are considerably changed.

Also, in view over time the unit of space modulation (pixel block) is shifted with respect to a subgroup of simultaneously selected row electrodes. Therefore, a period for matching these phases is considerably prolonged which may cause a sway of voltage in a long period of time and generate flickers or image dislocation.

It is necessary to match respective sequences or shorten the period for matching phases of the sequences to eliminate the noncoordination between the multiple line simultaneous selection method and the space modulation-FRC. The condition therefor is the above-mentioned "a number of row of space modulation unit J is equal to a number of simultaneously selected row electrode L or one is a multiple of the other".

Considering the size of space modulation, a flicker restraining effect, a frame response restraining effect and a circuit structure of the multiple line simultaneous selection, the simultaneously selected line number L is preferably about 2 through 15 and the number of row of space modulation unit J is preferably equal to L or a divisor (or a multiple) thereof. Especially, J is determined as 2 through 7. For example, L=4 and J=2 is an example of preferable combination and the gray scale can be expressed by FRC with 3 through 16 frames as a unit.

In the embodiment which has been exemplified by using Equation 1 and FIG. 1, L=4 and J=2 which satisfies the above-mentioned condition. The pixel block sizes of space modulation with regard to L=4 are exemplified as 2 rows 2 and columns, 4 rows and 2 columns, 4 rows and 4 columns, 4 rows and 6 columns, 8 rows and 8 columns etc. A generally used space modulation of 3 rows and 3 columns is not a preferable size with regard to L=4.

The sequence of the selection vector is a very important factor for reducing cross talk and flickers since a dot pattern is related to the column electrode voltage. It is required that 1) a series of selection pulses (selection column vector sequence) is periodic and 2) the period is sufficiently smaller than the frame length.

When these conditions are satisfied flickers inherent in the multiple line simultaneous selection can sufficiently be restrained. The following sequence can be used to satisfy the conditions of 1) and 2). The subgroups are selected successively by a repeat cycle of $A_1 \rightarrow A_2 \rightarrow A_3 \rightarrow A_4$ by using the respective selection vectors by every H times ($M/2 \geqq H \geqq 1$, M designates number of subgroup). Selection pulses corresponding to signs of elements of the selection row vectors are applied on the respective row lines of the selected subgroup. Meanwhile, 0 voltage is applied on the respective row lines of nonselected subgroups.

It is necessary for correctly determining the effective voltage in the multiple line simultaneous selection system to apply voltages corresponding to all the selection column vectors of $A_1$, $A_2$, $A_3$ and $A_4$ in one display frame with regard to all the subgroups.

Next, variation of column electrode voltages is noted. When FRC is used along with space modulation, various dot patterns are caused in each frame in accordance with ways of making respective tables. At this occasion, when the probability of existing dot patterns causing large variation in the column electrode voltages y is high, large cross talk is caused which deteriorates uniformity of intermediate gray scale display. Therefore, it is preferable to set tables such that many dot patterns which do not vary y considerably over time are present.

Specifically, it is preferable that the phase of the space modulation is set such that a total ratio of first ON/OFF patterns each applying an equal effective voltage on all of the pixels in the column and second ON/OFF patterns each applying a column voltage having an absolute value equal to an absolute value of the column voltage in the first ON/OFF patterns in each frame in displaying an intermediate gray scale level by all of the pixels belonging to the same subgroup is 60% or more on an average of all of the intermediate gray scale levels and all of the frames.

Especially, in performing 4 line simultaneous selection by using a matrix of Equation 2 shown below as a selection matrix, the full ON pattern, the full OFF pattern and the ON/OFF repeat pattern can be displayed by two column voltage levels. Five column voltage levels are generally necessary in the 4 line simultaneous selection. Further, two column voltage levels used here have opposite polarities and the same absolute value. This signifies that the column voltage does not vary considerably in switching gray scale data and deterioration of image quality accompanied by the variation in the column voltage can considerably be reduced when the display is performed with the full ON pattern, the full OFF pattern and the ON/OFF repeat pattern as key notes.

$$\begin{bmatrix} -1 & 1 & 1 & 1 \\ 1 & 1 & -1 & 1 \\ 1 & -1 & 1 & 1 \\ 1 & 1 & 1 & -1 \end{bmatrix} \quad (2)$$

It is generally preferable that cross talk is reduced irrespective of whether the solid probability is 40% or more that the phase of space modulation is adjusted such that a total ratio of patterns of ON or OFF for all the pixels in the column and other patterns having column drive voltages of which absolute value is equal to those of the ON or OFF patterns, is 60% or more on an average with regard to all the intermediate gray scale levels and all the frames, in each frame displaying one intermediate gray level by all the pixels belonging to the same subgroup. When the ratio is very large, excellent image may be provided even if the solid probability is a little lower than 40%. It is naturally more preferable in view of the reduction of cross talk to make the solid probability 40% or more at the same time.

The space modulation size of 2 rows and h columns is suitable for the drive system of the present invention since only the full ON, the full OFF or the ON/OFF patterns are present.

From such a point of view an ON/OFF table having a size of, for example, 2 rows and 4 columns, 4 rows and 4 columns, 4 rows and 8 columns for L=4 and a space modulation wherein upper bits are allocated obliquely (in a cross arrangement). A simple magic number matrix is not preferable since various dot patterns are present and cross talk is caused in intermediate gray scales.

For example, there are many combinations of tables in which numerals of 0 through 7 are allocated twice in a 4×4 size and totals in vertical, horizontal and oblique directions are 14. According to a kind of ON/OFF tables among them, the number of gray scales is 9 (the number of intermediate gray scales is 7) and there are a total of 28 dot patterns in the column direction. However, the total number of full ON patterns, full OFF patterns and ON/OFF patterns is 12 which is not suitable for the driving method in this invention.

In multi gray scale display, there is a method of indicating many gray scales by a short frame which combines a plurality of FRCs having different frame numbers. The present invention is also applicable to this case. However, it is preferable that the frame number of the used plurality of FRCs include 2 or 3 or 5 or 7 as a common divisor and the periodicity of elements of the threshold table is constituted by a common divisor thereof.

For example, by using both FRC of 4 frames and FRC of 6 frames 9 gray scales of 0, 1/6, 1/4, 2/6, 2/4, 4/6, 3/4, 5/6, 1 can be achieved by the longest one of 6 frames. In this case it is preferable that the periodicity of elements of the threshold table is 2 that is a common divisor of the frame number of the respective FRCs. Thereby, the solid probability can be enhanced and display having little cross talk can be performed.

Meanwhile, in case where FRC of 4 frames and FRC of 5 frames are used, a long period of approximately 20 frames is caused as a light pattern period and accordingly, flickers are conspicuous.

Further, a method of factitiously increasing gray scale display by using the dithering method in the gray scale display is well known. The present invention is also applicable to this case. However, it is necessary to use the same phase for the space modulation with regard to a unit of dithering. For example, when the dithering is applied with 2×2 as a unit, the same phase is used with respective 2 pixels in rows or columns as one set. In this way image dislocations and flickers by the dithering can be restrained.

As specific method of dithering, there are a case in which information of dithering is included in inputted original data and a case in which gray scale display is performed by dithering although original data does not include information of dithering. The present invention is applicable to both of the cases. In the latter case a phase table with regard to dithered data can be switched to a phase table with regard to undithered data.

The present invention is naturally applicable to a case in which other gray scale system such as the amplitude modulation or the pulse height modulation is used along with FRC. The present invention is very effective in a method in which a method of expressing gray scales over a plurality of frames is combined with the space modulation.

Further, in multicolor display when phase is reversed depending on color, restraining effect of flickers is more enhanced and uniform gray scale display can be achieved. For example, it is possible that red and blue are made stay in the same phase and only the phase of green is reversed.

As mentioned above, according to the present invention image having high quality can be provided without deteriorating advantages of respective systems by driving by the space modulation-FRC and the multiple line simultaneous selection method by satisfying specific relations.

The present invention can be realized simply by using a conventionally known multiple line simultaneous selection circuit. In the space modulation-FRC, multi bits data of an initial stage are inputted to a prestage for storing to a memory, 1 bit (1 frame) data after FRC is stored in the memory, a column electrode voltage waveform is calculated by the multiple line simultaneous selection calculation by successively reading the data. Or, the multi bits data are stored as they are and 1 bit of FRC data may be formed at the prestage of the column voltage calculation in reference to the tables of the space modulation-FRC. The threshold table and the phase table may be stored in a ROM and read successively therefrom. However, it is easy to constitute them by a logical circuit.

EXAMPLES

Example 1

Color STN display elements of VGA (840×480×3(RGB)) were divided into top and bottom two screens and dual scan driving was performed. A number of row lines in one screen was 240 and the multiple line simultaneous selection driving was performed with the simultaneous selection number of L=4 (that is, subgroup number=60). The driving was performed with the frame frequency of 120 Hz and the response time (average of rise time and decay time) was 60 ms.

A selection matrix used in this example was as shown by Equation (2) and when respective column vectors of the selection matrix were specified as $A_1$, $A_2$, $A_3$ and $A_4$ in this order from left, a series of selection pulses were set in the order of $A_1, A_2, A_3, A_4, A_1, A_2, A_3, A_4, A_1, A_2, A_3, A_4, \ldots$ Polarities were reversed at every 7 pulses by which alternating current driving was performed.

FRC of 8 frames and dithering of 2 bits (2×2) were used as a gray scale system. First, lower 2 bits of 5 bits input were dithered and converted into data of 3 bits for each color which were displayed by FRC along with space modulation.

A pixel block that was a unit of space modulation was consisted of 4×4 pixels and one subgroup were included in one pixel block. A threshold table and a phase table specified by the following equation (3) were used.

$$T_1(n)=(0, 7, 2, 5, 1, 6, 3, 4) \tag{3}$$

$$P_1(i,j)=\begin{bmatrix} 0 & 6 & 4 & 2 \\ 4 & 6 & 0 & 2 \\ 4 & 2 & 0 & 6 \\ 0 & 2 & 4 & 6 \end{bmatrix}$$

The solid probability in using the threshold table and the phase table was 85.7% and a ratio (hereinafter ON/OFF probability) of patterns having a drive voltage of an absolute value equal to those of all ON pattern or all OFF pattern (in this case pattern having ON/ON/OFF/OFF) in each frame in displaying one intermediate gray scale level by all the pixels belonging to the same subgroup was 14.3%.

As a result 31 gray scale displays (8 gray scales in dot unit) having almost no flicker was provided at each gray scale and dynamic display having a contrast ratio of 40:1 was provided.

Next, the phase the threshold table was reversed only with respect to green as shown by the following equation (4).

$$T_2(n)=(4, 3, 6, 1, 5, 2, 7, 0) \tag{4}$$

The solid probability and the ON/OFF probability in using such a threshold table and the phase table remains the same as in the case of using $T_1(n)$ as the threshold table. However, the level of flickers was further reduced and the image quality was improved.

Further, as a phase table used in an undithered case (that is lower 2 bits of input data were 0) $P_2(i,j)$ shown by the following equation (5) was prepared and the phase table of the equation (3) and the phase table of equation (5) were used by switching them according to display data. The solid probability in using the threshold table and the phase table was 85.7% and the ON/OFF probability was 14.3%. An image having a low flicker level was provided similarly also in this case.

$$P_2(i,j)=\begin{bmatrix} 0 & 6 & 4 & 2 \\ 4 & 2 & 0 & 6 \\ 0 & 6 & 4 & 2 \\ 4 & 2 & 0 & 6 \end{bmatrix} \tag{5}$$

Example 2

In Example 1 the input was made 6 bits for each color, FRC having 6 frames was applied, and a display of 13 gray scales in dot unit and 51 gray scales including 2 bits of dithering was performed.

In the case of 6 frames the pixel block of space modulation was constituted by 6×3 pixels. The threshold table and the phase table were as specified by the following equation (6). These tables are used when gray shade levels 2/15, 5/15, 7/15, 8/15, 10/15 and 12/15 are displayed.

$$T_3(n)=(1, 14, 7, 9, 4, 11) \tag{6}$$

$$P_3(i,j)=\begin{bmatrix} 0 & 4 & 2 \\ 4 & 2 & 0 \\ 4 & 2 & 0 \\ 2 & 0 & 4 \\ 2 & 0 & 4 \\ 0 & 4 & 2 \end{bmatrix}$$

Further, the pixel block that was the unit of space modulation of 8 frames was constituted by 4×4 pixels. The threshold table and the phase table were as shown by the following equation (7). These tables are used when gray shade level 1/15, 3/15, 4/15, 6/15, 7/15, 8/15, 9/15, 11/15, 13/15 and 14/15 are displayed.

$$T_4(n)=(0, 14, 5, 10, 2, 12, 6, 8) \tag{7}$$

$$P_4(i,j)=\begin{bmatrix} 0 & 6 & 4 & 2 \\ 4 & 6 & 0 & 2 \\ 4 & 2 & 0 & 6 \\ 0 & 2 & 4 & 6 \end{bmatrix}$$

The solid probability in using the threshold table and the phase table was 76.8% and the ON/OFF probability was 13.7%. Improved image in which no flicker and no low frequency were observed was provided also in this case.

Example 3

Color STN display elements of VGA (640×480×3(RGB)) were divided into top and bottom two screens and dual scan driving was performed. The number of row electrodes in one screen was 240 and the multiple line simultaneous selection driving was performed with the simultaneous selection number of L=4 (that is, subgroup number=60). The driving was performed with the frame frequency of 120 Hz and the response time (average of rise time and decay time) was 60 ms.

A selection matrix used in this example was as shown by equation (2) and when respective vectors of the selection matrix were designated as $A_1$, $A_2$, $A_3$ and $A_4$ in this order from left, a series of selection pulses was set in the order of $A_1, A_1, A_1, A_1, A_2, A_2, A_2, A_2, A_3, A_3, A_3, A_3, \ldots$ Polarities were reversed at every 7 pulses by which the alternating current driving was performed.

Figure 2:
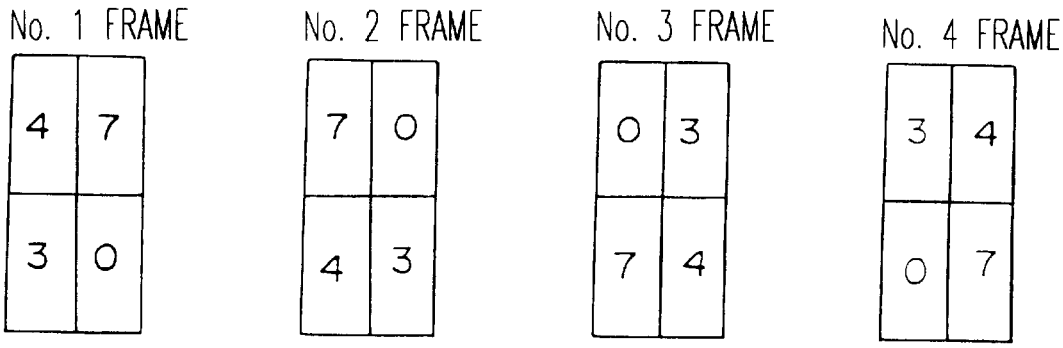
FIG. 2 illustrates ON/OFF tables of space modulation used in a first embodiment of a method of driving a liquid crystal display device of the present invention.

As the gray scale system input of 4 bits (16 gray scales) was allocated in 9 gray scales and ON/OFF tables for respective frames as shown by FIG. 2 was used by which 4 frames 5 gray scales driving was performed. Simultaneously selected four lines were made belong to the same pixel block.

The solid probability in using the threshold table and the phase table was 50.0% and the ON/OFF probability was 50.0%. As a result, although the number of gray scales was reduced and natural appearance in a video display was lost, almost no flicker was generated and a very uniform display was provided.

Example 4

A liquid crystal display panel similar to that in Example 1 was similarly driven by the 4 line simultaneous selection method. However, no dithering was performed and FRC of 4 frames and 5 gray scales was used along with space modulation with 2×4 pixel block as a unit. Two rows of a pixel block that was a unit of space modulation corresponded to 4 rows of simultaneously selected row electrodes. The threshold table and the phase table are shown by the following equation (8).

$$T_5(n)\ (0, 2, 1, 3) \tag{8}$$

$$P_5(i,j) = \begin{bmatrix} 0\ 3\ 2\ 1 \\ 2\ 1\ 0\ 3 \end{bmatrix}$$

The solid probability in using the threshold table and the phase table was 66.7% and the ON/OFF probability was 33.3%. An image having very little cross talk and flicker was provided.

Example 5

A liquid crystal panel similar to Example 1 was similarly driven by the 4 line simultaneous selection method. However, no dithering was performed and FRC of 4 frames and 5 gray scales was used along with space modulation with a pixel block of 2×4 as a unit. Two of two rows of pixel blocks each of which was the unit of the space modulation corresponded to 4 rows of simultaneously selected row electrodes. The threshold table and the phase table are shown by the following equation (9).

$$T_6(n)=(0, 1, 2, 3) \tag{9}$$

$$P_6(i,j) = \begin{bmatrix} 0\ 3\ 2\ 1 \\ 2\ 1\ 0\ 3 \end{bmatrix}$$

The solid probability in using the threshold table and the phase table was 33.3% and the ON/OFF probability was 66.7%. An image approximately the same with that in Example 4 having little cross talk and flicker was provided.

Example 6

A liquid crystal display panel similar to that in Example 1 was similarly driven by the 4 lines simultaneous selection method. However, dithering was not performed and FRC of 4 frames and 5 gray scales was used along with space modulation with a pixel block of 4×4 as a unit. 4 lines of the pixel block which was the unit of space modulation corresponded to 4 lines of simultaneously selected row electrodes. The threshold table and the phase table are shown by the following equation (10).

$$T_7(n)=(0, 2, 1, 3) \tag{10}$$

$$P_7(i,j) = \begin{bmatrix} 0\ 1\ 2\ 3 \\ 2\ 1\ 0\ 3 \\ 2\ 3\ 0\ 1 \\ 0\ 3\ 2\ 1 \end{bmatrix}$$

The solid probability of using the threshold table and the phase table was 66.7% and the ON/OFF probability was 33.3%. An image having little cross talk and flicker which is inferior to that in Example 4 but superior to that in Example 5 was provided.

Example 7

A liquid crystal display panel similar to that in Example 1 was similarly driven by the 4 line simultaneous selection method. However, dithering was not performed and FRC of 4 frames and 5 gray scales was used along with space modulation with a pixel block of 4×4 as a unit. 4 lines of the pixel block that was the unit of space modulation corresponded to 4 lines of simultaneously selected row electrodes. The threshold table and the phase table are shown by the following equation (11).

$$T_8(n)=(0, 2, 1, 3) \tag{11}$$

$$P_8(i,j) = \begin{bmatrix} 0\ 2\ 1\ 3 \\ 2\ 0\ 3\ 1 \\ 3\ 1\ 2\ 0 \\ 1\ 3\ 0\ 2 \end{bmatrix}$$

The solid probability in using the threshold table and phase table was 0% and the ON/OFF probability was 25%. Cross talk was considerable.

Example 8

A liquid crystal display panel similar to that in Example 1 was similarly driven by the 4 line simultaneous selection method. However, dithering was not performed and FRC of 3 frames and 4 gray scales was used along with space modulation with a pixel block of 3×3 as a unit. The threshold table and the phase table are shown by the following equation (12).

$$T_8(n)=(0, 1, 2) \tag{12}$$

$$P_8(i,j) = \begin{bmatrix} 0\ 1\ 2 \\ 2\ 0\ 1 \\ 1\ 2\ 0 \end{bmatrix}$$

The solid probability in using the threshold table and the phase table was 0% and the ON/OFF probability was 33.3%. Cross talk was considerable.

The present invention can realize high-speed and high contrast ratio display of multi gray scales without deteriorating both characteristics of the multiple line simultaneous selection method and the space modulation-FRC and can realize dynamic multi gray scale display by a simple matrix which has conventionally not been achieved. Further, high timewise and spatial uniformity having less cross talk and flicker than those in the conventional driving method can be achieved.

What is claimed is:

1. A method of driving an image display device comprising the steps of:

dividing row electrodes of an image display device having a plurality of row electrodes and a plurality of column electrodes into a plurality of subgroups;

selecting summarizingly one of the plurality of subgroups;

applying voltages based on signals formed by expanding time-sequentially column vectors of an orthogonal matrix on the row electrodes;

performing a gray scale display by a frame rate control (FRC) by using a plurality of frames;

performing a space modulation shifting a phase of the FRC with a pixel block comprising a plurality of pixels as a unit; and wherein the phase of the space modulation is set such that a ratio of the columns each applying an equal effective voltage with regard to all of the pixels in the column belonging to a subgroup in each frame in displaying an intermediate gray scale level on all of the pixels belonging to the subgroup is at least 40% on an average of all of the intermediate gray scale levels and all of said plurality of frames.

2. The method of driving an image display device according to claim 1, wherein the phase of the space modulation is set such that a ratio of the columns each applying ON or OFF on all of the pixels in the column in each frame in displaying an intermediate gray scale level by all of the pixels belonging to the same subgroup is 40% or more on an average of all of the intermediate gray scale levels and of all of said plurality of frames.

3. The method of driving an image display device according to claim 1, wherein a line number J of the rows of the pixel block performing the space modulation is equal to a number L of the simultaneously selected rows or J is a multiple of L or L is a multiple of J.

4. The method of driving an image display device according to claim 1, wherein the phase of the space modulation is set such that a total ratio of first ON/OFF patterns each applying an equal effective voltage on all of the pixels in the column and second ON/OFF patterns each applying a column voltage having an absolute value equal to an absolute value of the column voltage in the first ON/OFF patterns in each frame in displaying an intermediate gray scale level by all of the pixels belonging to the same subgroup is 60% or more on an average of all of the intermediate gray scale levels and all of said plurality of frames.

5. The method of driving an image display device according to claim 4, wherein a total ratio of third ON/OFF patterns each applying ON or OFF on all of the pixels in the column and fourth ON/OFF patterns each having a column voltage having an absolute value equal to an absolute value of the column voltage in the third ON/OFF patterns in each frame in displaying an intermediate gray scale level by all of the pixels belonging to the same subgroup is 60% or more on an average of all of the intermediate gray scale levels and all of said plurality of frames.

6. The method of driving an image display device according to claim 1, wherein a plurality of FRCs each having a different number of the frames are combined.

7. The method of driving an image display device according to claim 1, wherein a gray scale display by dithering is also used.

8. The method of driving an image display device according to claim 1, wherein a multi color display is performed and the phase of the space modulation with respect to one color is reversed in comparison with phases of other colors.

9. A method of driving an image display device comprising the steps of:

dividing row electrodes of an image display device having a plurality of row electrodes and a plurality of column electrodes into a plurality of subgroups;

selecting summarizingly one of the plurality of subgroups;

applying voltages based on signals formed by expanding time-sequentially column vectors of an orthogonal matrix on the row electrodes;

performing a gray scale display by a frame rate control (FRC) by using a plurality of frames;

performing a space modulation shifting a phase of the FRC with a pixel block comprising a plurality of pixels as a unit; and wherein the phase of the space modulation is set such that a total ratio of first ON/OFF patterns each applying an equal effective voltage on all of the pixels in the column and second ON/OFF patterns each applying a column voltage having an absolute value equal to an absolute value of the column voltage in the first ON/OFF patterns in each frame in displaying an intermediate gray scale level by all of the pixels belonging to the same subgroup is at least 60% on an average of all of the intermediate gray scale levels and all of said plurality of frames.

10. The method of driving an image display device according to claim 9, wherein a total ratio of third ON/OFF patterns each applying ON or OFF on all of the pixels in the column and fourth ON/OFF patterns each having a column voltage having an absolute value equal to an absolute value of the column voltage in the third ON/OFF patterns in each frame in displaying an intermediate gray scale level by all of the pixels belonging to the same subgroup is 60% or more on an average of all of the intermediate gray scale levels and all of said plurality of frames.

11. The method of driving an image display device according to claim 9, wherein a line number J of the rows of the pixel block performing the space modulation is equal to a number L of the simultaneously selected rows or J is a multiple of L or L is a multiple of J.

12. The method of driving an image display device according to claim 9, wherein a plurality of FRCs each having a different number of the frames are combined.

13. The method of driving an image display device according to claim 9, wherein a gray scale display by dithering is also used.

14. The method of driving an image display device according to claim 9, wherein a multi color display is performed and the phase of the space modulation with respect to one color is reversed in comparison with phases of other colors.

* * * * *